US010597197B2

(12) United States Patent
Verma

(10) Patent No.: US 10,597,197 B2
(45) Date of Patent: Mar. 24, 2020

(54) BISTABLE PULL-SNAP HOLD OPEN MECHANISM AND METHOD

(71) Applicant: Vishaal B. Verma, Evanston, IL (US)

(72) Inventor: Vishaal B. Verma, Evanston, IL (US)

( * ) Notice: Subject to any disclaimer, the term of this patent is extended or adjusted under 35 U.S.C. 154(b) by 322 days.

(21) Appl. No.: 15/605,804

(22) Filed: May 25, 2017

(65) Prior Publication Data

US 2017/0355491 A1 Dec. 14, 2017

Related U.S. Application Data

(63) Continuation-in-part of application No. 13/943,601, filed on Jul. 16, 2013, now Pat. No. 9,663,271.

(60) Provisional application No. 61/741,259, filed on Jul. 16, 2012.

(51) Int. Cl.

| | |
|---|---|
| ***B65B 67/04*** | (2006.01) |
| ***B65D 33/00*** | (2006.01) |
| ***B65D 33/02*** | (2006.01) |

(52) U.S. Cl.

CPC ..... *B65D 33/007* (2013.01); *B65D 33/02* (2013.01)

(58) Field of Classification Search

CPC ..... B65D 33/07; B65D 33/02
USPC ..... 248/99; 24/30.5 R; 383/33, 35, 43, 63, 383/107

See application file for complete search history.

(56) References Cited

U.S. PATENT DOCUMENTS

| | | | |
|---|---|---|---|
| 199,507 | A | 1/1878 | Brubaker |
| 1,463,113 | A | 7/1923 | Bibb |
| 1,887,940 | A | 11/1932 | Marinsky |
| 2,008,314 | A | 7/1935 | Russell |
| 2,040,271 | A | 5/1936 | Rosenzweig |
| 2,064,696 | A | 12/1936 | Smith et al. |
| 2,074,843 | A | 3/1937 | Hiering |
| 2,142,904 | A | 1/1939 | Lamarthe |
| 2,150,627 | A | 3/1939 | Lieber |

(Continued)

FOREIGN PATENT DOCUMENTS

| | | |
|---|---|---|
| EP | 2112085 | 10/2009 |
| GB | 189726598 | 11/1898 |

(Continued)

OTHER PUBLICATIONS

Impact Advanced Concepts, "Snap-Span", earliest available publication Apr. 8, 2012, https://web.archive.org/web/20120408231153/http://www.snap-span.com/ downloaded Apr. 29, 2014 (2 pages).

(Continued)

*Primary Examiner* — Gwendolyn W Baxter

(57) ABSTRACT

Provided is a fitment bistable pull-snap hold open mechanism including a flexible first and second flat, strip like members with one or more pivot members integrated into the second flat, strip like member. The first flat, strip like member is coupled to the second flat, strip like member at their respective ends with two or more bonding points. The one or more pivot members include a vertical living hinge and a flexure, which allows the mechanism to be biased between an open configuration and a closed configuration. The vertical living hinge does not extend to the top edge or the bottom edge of the second flat, strip like member to improve the integrity of the mechanism. The first and second flat, strip like members are applied proximate the opening of a flexible package on the inside walls and allow the package to be maintained in the open position for removing its contents.

92 Claims, 9 Drawing Sheets

(56) References Cited

U.S. PATENT DOCUMENTS

| | | | |
|---|---|---|---|
| 2,158,955 | A | 5/1939 | Blacher |
| 2,578,612 | A | 12/1951 | Stregack |
| 2,693,212 | A | 11/1954 | Guichard |
| 3,310,224 | A | 3/1967 | Laguerre |
| 3,313,469 | A | 4/1967 | Drozda |
| 4,069,994 | A | 1/1978 | Wharmby |
| 4,479,244 | A | 10/1984 | Ausnit |
| 4,486,923 | A | 12/1984 | Briggs |
| 4,664,348 | A | 5/1987 | Corsaut, III et al. |
| 4,753,367 | A | 6/1988 | Miller et al. |
| 4,753,489 | A | 6/1988 | Mochizuki |
| 4,758,099 | A | 7/1988 | Branson |
| 4,815,866 | A | 3/1989 | Martone |
| 4,848,930 | A | 7/1989 | Williams et al. |
| 5,035,518 | A | 7/1991 | McClintock |
| 5,037,138 | A | 8/1991 | McClintock et al. |
| 5,044,774 | A | 9/1991 | Bullard et al. |
| 5,082,219 | A | 1/1992 | Blair |
| 5,183,227 | A | 2/1993 | Wilhite |
| 5,184,896 | A | 2/1993 | Hammond et al. |
| 5,524,990 | A | 6/1996 | Buck |
| 5,609,419 | A | 3/1997 | Byers, Jr. |
| 5,676,306 | A | 10/1997 | Lankin et al. |
| 5,716,138 | A | 2/1998 | Southwell |
| 6,022,144 | A | 2/2000 | Hausslein |
| 6,149,304 | A | 11/2000 | Hamilton et al. |
| 6,164,821 | A | 12/2000 | Randall |
| 6,231,235 | B1 | 5/2001 | Galomb et al. |
| 6,234,674 | B1 | 5/2001 | Byers, Jr. |
| 6,234,676 | B1 | 5/2001 | Galomb et al. |
| 6,273,608 | B1 | 8/2001 | Ward, Jr. et al. |
| 6,345,911 | B1 | 2/2002 | Young et al. |
| 6,508,587 | B1 | 1/2003 | Byers, Jr. |
| 6,572,267 | B1 | 6/2003 | Forman |
| 6,578,585 | B1 | 6/2003 | Stachowski et al. |
| 6,678,923 | B2 | 1/2004 | Goldberg et al. |
| 6,899,460 | B2 | 5/2005 | Turvey et al. |
| 6,904,647 | B2 | 6/2005 | Byers, Jr. |
| 7,347,623 | B2 | 3/2008 | Cawley |
| 7,416,337 | B2 | 8/2008 | Munch-Fals |
| 7,681,784 | B2 | 3/2010 | Lang |
| 8,333,351 | B2 | 12/2012 | Kramer |
| 8,474,623 | B2 | 7/2013 | Villarrubia |
| 8,678,650 | B2 | 3/2014 | Savage |
| 2003/0033694 | A1 | 2/2003 | Cisek |
| 2004/0195467 | A1 | 10/2004 | Passage |
| 2004/0208400 | A1 | 10/2004 | Linneweil |
| 2005/0137073 | A1 | 6/2005 | Weaver |
| 2005/0281487 | A1 | 12/2005 | Pawlowski et al. |
| 2006/0010659 | A1 | 1/2006 | Penn |
| 2006/0050999 | A1 | 3/2006 | Blythe et al. |
| 2006/0280386 | A1 | 12/2006 | Bublitz |
| 2008/0019618 | A1 | 1/2008 | Dayton et al. |
| 2009/0046955 | A1 | 2/2009 | Schember et al. |
| 2011/0188785 | A1 | 8/2011 | Turvey et al. |
| 2011/0226914 | A1 | 9/2011 | Fleming |
| 2012/0138623 | A1 | 6/2012 | Verma |
| 2013/0064480 | A1 | 3/2013 | Verma |
| 2013/0248541 | A1 | 9/2013 | Verma |
| 2014/0014789 | A1 | 1/2014 | Verma |
| 2014/0259868 | A1 | 9/2014 | Wilson |
| 2014/0314342 | A1 | 10/2014 | Verma |

FOREIGN PATENT DOCUMENTS

| | | |
|---|---|---|
| JP | 51017122 | 2/1976 |
| JP | 2000085905 | 3/2000 |
| JP | 2003072779 | 3/2003 |
| WO | 9900312 | 1/1999 |

OTHER PUBLICATIONS

Jokari, "Baggy Rack Pro" earliest avaiable publication Nov. 15, 2012 https://web.archive.org/web/20121115010901/http://www.jokari.com/products/G_169606.html downloaded Apr. 29, 2014 (1 page).

International Search Report and Written Opinion, International Application No. PCT/US2014/035154, dated Aug. 29, 2014, (7 pages).

International Search Report and Written Opinion, International Application No. PCT/US2012/068314, dated Mar. 14, 2013 (6 pages).

International Search Report and Written Opinion, International Application No. PCT/US2011/062840, dated Apr. 23, 2012 (6 pages).

U.S. Office Action, U.S. Appl. No. 12/958,217, dated Nov. 6, 2012 (8 pages).

U.S. Office Action, U.S. Appl. No. 12/958,217, dated Apr. 12, 2013 (10 pages).

U.S. Office Action, U.S. Appl. No. 13/485,773, dated Nov. 14, 3 (13 pages).

U.S. Office Action, U.S. Appl. No. 14/259,868, dated Jul. 9, 2015 (12 pages).

U.S. Office Action, U.S. Appl. No. 13/786,068, dated Apr. 13, 2015, (26 pages).

BISTABLE PULL-SNAP HOLD OPEN MECHANISM AND METHOD

CROSS-REFERENCE TO RELATED APPLICATIONS

This application is a continuation-in-part of U.S. Non-provisional patent application Ser. No. 13/943,601 filed on Jul. 16, 2013, which claims priority from and the benefit of U.S. Provisional Application No. 61/741,259 filed Jul. 16, 2012, the disclosures of which are incorporated herein by reference in their entireties.

FIELD OF THE INVENTION

The invention relates to a hold open mechanism. More particularly, embodiments relate to a hold open mechanism used with a package, bag, or container and a method of accessing a package, bag, or container having hold open mechanism.

BACKGROUND OF THE INVENTION

Pliable containers are widely used to store both edible and non-edible products. For example, snack items, such as various types of chips and cereals, are typically packaged in pliable containers. These containers are generally sealed at both ends for initial packaging purposes and then one end is opened to access the product. It may be desirable to reuse the container to store the product for extended periods of time, allowing repeated access to the interior of the container.

When used to store edible food items for example, it is particularly advantageous to adequately seal the open end of the container between uses in order to prolong the useful life of the products stored therein. For this reason, once the initial seal at one end of the container is broken, it is common practice to roll up the openable end of the pliable container for storage. Unfortunately, the rolled-up ends of such pliable containers generally tend to unroll between uses, which may lead to the food items becoming stale or non-edible.

Proposed solutions to this problem include providing various types of closure mechanisms at the open end of the container to maintain the side walls of the container in a closed relationship for sealing purposes. For example, it is known to use a clip to prevent the openable container end from unrolling. Since such clips are completely separate from the container, they can be misplaced and are therefore often only used when readily available. In addition, these clips often tend to break and only directly maintain a small central section of the openable container end in a rather tight, closed condition. Zip-type or slider type closure arrangements have also become quite prevalent for use with certain types of pliable containers. Such closure arrangements are considered advantageous in that they generally extend across the entire width of the open end and are formed integral to the container. However, such closure arrangements alone do not enhance the accessibility to the interior of a container when the container is opened. More specifically, such closure arrangements do not maintain the side walls of the container in an open position, at least at the open end of the container, to permit easy access to the contents.

For the foregoing reasons, there is a need for a simple, inexpensive hold open mechanism for use with pliable containers that will enhance accessibility in the open position while not inhibiting or preventing resealing functionality in the closed or sealed position.

SUMMARY OF THE INVENTION

One embodiment relates to a bistable pull-snap hold open mechanism that allows a user to easily access the contents of a flexible package. It's designed to fit proximate the opening of a package generally complimenting the functionality of a zip type closure. The device is comprised of a first and second flat strip like member coupled by one or more locking or bistable hinge mechanisms. The locking hinge mechanisms generally include a standard living hinge in addition to one or more spring flaps or flexures which allow the hinge to be biased in an open or closed configuration. When the user wishes to open the package and hold it in this configuration, all that is required is a slight pressure applied to the side walls of the package. When the mechanism reaches a certain point, the hinges lock thus maintaining the sidewalls of the container in an open configuration. When the user wishes to close the mechanism, a slight pressure applied to the external surface of the sidewalls inwards results in the hinges unlocking and rotating towards a closed configuration. The user can then use the zip-type closure to seal the package.

Another embodiment relates to a tape feed bistable hold open mechanism including a flexible first flat, strip like member comprised of a polyolefin material and a flexible second flat, strip like member positioned relative to the first flat strip like member, the second flat, stripe like member comprised of a polyolefin. The first flat, strip like member includes a first end; a second end opposite the first end; an inner mating surface; and an outer bonding surface opposite the inner mating surface. The second flat, strip like member includes a first end; a second end opposite the first end; an inner mating surface; and an outer bonding surface opposite the inner mating surface. One or more pivot members is integrated into the second flat, strip like member separating the second flat, strip like member into a side seal portion and an operable portion, the side seal portion coupled to the operable portion.

Another embodiment relates to a fitment bistable pull-snap hold open mechanism, comprising: a flexible first flat, strip like member comprised of a polyolefin material having: a first end; a second end opposite the first end; an inner mating surface; an outer bonding surface opposite the inner mating surface; a flexible second flat, strip like member positioned relative to the first flat strip like member, the second flat, stripe like member comprised of a polyolefin having: a first end; a second end opposite the first end; an inner mating surface; an outer bonding surface opposite the inner mating surface; one or more pivot members integrated into the second flat, strip like member separating the second flat, strip like member into a side seal portion and an operable portion, the side seal portion coupled to the operable portion, wherein the first flat, strip like member is coupled to the second flat, strip like member at both the first ends and the seconds ends with two or more bonding points at each of the first and second ends. In this embodiment the one or pivot members comprise a vertical living hinge and a flexure allowing the fitment bistable pull-snap hold open mechanism to be biased between an open configuration and a closed configuration and the vertical living hinge does not extend to the top edge or the bottom edge of the second flat, strip like member. The first flat, strip like member and the second flat, strip like member are applied proximate the opening of a flexible package on the inside walls of the package.

Still another embodiment relates to a method of using the tape feed hold open mechanism. The method comprises applying a separating pressure between the first flat, strip like member and second flat, strip like member; sliding the flexure from a first flat configuration to a second bent configuration, holding the first member separate from the second member allowing easy access to the contents of the package; applying a compressive pressure between the first and second member; and sliding the flexure from a second bent configuration to a first flat configuration thus closing and mating the first member relative to the second member.

One other embodiment relates to a fitment bistable hold open mechanism, comprising a flexible first flat, strip like member comprised of a polyolefin material and a flexible second flat, strip like member positioned relative to the first flat strip like member, the second flat, stripe like member comprised of a polyolefin. The flexible first flat, strip like member has an inner mating surface; an outer bonding surface opposite the inner mating surface. The flexible second flat, strip like member positioned relative to the first flat strip like member, the second flat, stripe like member has a first edge; an inner mating surface; an outer bonding surface opposite the inner mating surface; one or more pivot members pivotally coupling the first flat, strip like member to the second, flat strip like member.

Still yet another embodiment relates to a fitment bistable pull-snap hold open mechanism, comprising: a flexible first flat, strip like member comprised of a polyolefin material having: an inner mating surface; an outer bonding surface opposite the inner mating surface; a flexible second flat, strip like member positioned relative to the first flat strip like member, the second flat, stripe like member comprised of a polyolefin having: an inner mating surface; an outer bonding surface opposite the inner mating surface; one or more pivot members pivotally coupling the first flat, strip like member to the second, flat strip like member, wherein the first flat, strip like member is coupled to the second flat, strip like member at both the first ends and the seconds ends with two or more bonding points at each of the first and second ends. The one or pivot members comprise a vertical living hinge and one or more flexures allowing the fitment bistable pull-snap hold open mechanism to be biased between an open configuration and a closed configuration. With this embodiment, the vertical living hinge does not extend to the top edge or the bottom edge of the second flat, strip like member and does not extend to the top edge or the bottom edge of the one or more flexures. The first flat, strip like member and the second flat, strip like member are applied proximate the opening of a flexible package on the inside walls of the package.

Still one other embodiment relates to a method of using the fitment bistable hold open mechanism includes applying a separating pressure between the first flat, strip like member and second flat, strip like member; sliding the flexure from a first closed and disengaged configuration to a second open and engaged configuration, holding the first member separate from the second member allowing easy access to the contents of the package; applying a compressive pressure between the first and second member; and sliding the flexure from a second open and engaged configuration to a first closed and disengaged configuration thus closing and mating the first member relative to the second member.

But still yet another embodiment relates to a fitment bistable pull-snap hold open mechanism, comprising: a flexible first flat, strip like member comprised of a polyolefin material having: an inner mating surface; an outer bonding surface opposite the inner mating surface; a flexible second flat, strip like member positioned relative to the first flat strip like member, the second flat, stripe like member comprised of a polyolefin having: an inner mating surface; an outer bonding surface opposite the inner mating surface; one or more pivot members pivotally coupling the first flat, strip like member to the second, flat strip like member, wherein the first flat, strip like member is coupled to the second flat, strip like member at both the first ends and the seconds ends with a bonding area adjacent to each of the first and second ends. The one or pivot members comprise a vertical living hinge and one or more flexures allowing the fitment bistable pull-snap hold open mechanism to be biased between an open configuration and a closed configuration. With this embodiment, the vertical living hinge does not extend to the top edge or the bottom edge of the second flat, strip like member and does not extend to the top edge or the bottom edge of the one or more flexures. The first flat, strip like member and the second flat, strip like member are applied proximate the opening of a flexible package on the inside walls of the package. Embodiments include flexures which allow the pivot members or hinges to be biased in open or closed configurations. Applying a slight pressure to the members opens the mechanism. When the mechanism reaches a predetermined point, the pivot or hinges lock, maintaining an open configuration. Closing the mechanism only requires a slight pressure be applied to the external surface of the members, resulting in the pivot members or hinges unlocking and rotating towards a closed configuration.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

(FIG. 23B is a sectional view of "B" in FIG. 23A) illustrate the bistable pull-snap hold open mechanism or device with a male-female closure mechanism integrated near the top of the first, flat strip like member and the top of the second, flat strip like member.

(FIG. 24B is a sectional view of "B" in FIG. 24A) illustrate the bistable pull-snap hold open mechanism or device with a hook and hook closure mechanism integrated near the top of the first, flat strip like member and the top of the second, flat strip like member.

Throughout the various figures, like reference numbers refer to like elements.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. All numerical values within the detailed description and the claims herein are modified by "about" or "approximately" the indicated value, and take into account experimental error and variations that would be expected by a person having ordinary skill in the art.

Embodiments of the present invention are designed to augment the functionality of the conventional zip type closure mechanism. The bistable pull-snap hold open mechanism allows a user to easily access the contents of a flexible package. It's designed to fit proximate the opening of a package generally complimenting the functionality of a zip type closure. The device is comprised of a first and second flat strip like member coupled by one or more locking or bistable hinge mechanisms. The locking hinge mechanisms generally include a standard living hinge in addition to one or more spring flaps or flexures which allow the hinge to be biased in an open or closed configuration. When the user wishes to open the package and hold it in this configuration, all that is required is a slight pressure applied to the side walls of the package. When the mechanism reaches a certain point, the hinges lock thus maintaining the sidewalls of the container in an open configuration. When the user wishes to close the mechanism, a slight pressure applied to the external surface of the sidewalls inwards results in the hinges unlocking and rotating towards a closed configuration. The user can then use the zip-type closure to seal the package.

Figure 1:
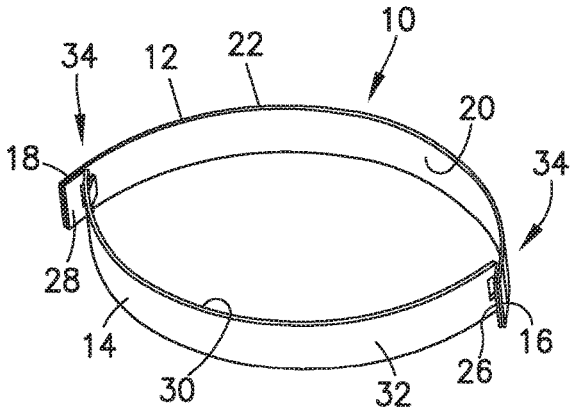
FIG. 1 is an isometric view of the tape feed style pull-snap hold open mechanism in an open position in accordance with one embodiment.
Figure 2:
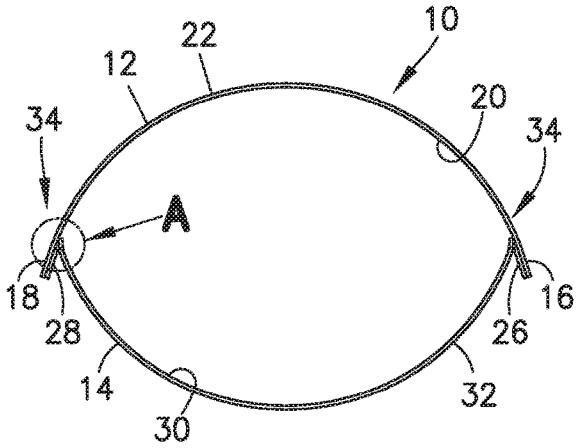
FIG. 2 is a top view of the hold open mechanism of FIG. 1 in an open position in accordance with one embodiment.

More particularly, FIGS. 1-2 depict views of the tape feed bistable hold open mechanism, generally designated 10, in accordance with one embodiment of the present invention, depicting the hold open mechanism 10 in a first or open position. In the illustrated embodiment, the hold open mechanism 10 includes at least a generally flexible first flat, strip like member 12 and a generally flexible second flat, strip like member 14. In at least one embodiment, the first flat, strip like member 12, the second, flat strip like member 14 or both are comprised of a polyolefin material. It should be realized that, while polyolefin material is discussed, other materials and combinations are also contemplated.

As illustrated, the first flat, strip like member 12 has a first orientation defined with respect to a length of the second flat, strip like member 14, a first end 16, a second end 18 opposite the first end 16, an inner mating surface 20, and an outer bonding surface 22 opposite the inner mating surface 20. Similarly, the second flat, strip like member 14 has a first orientation defined with respect to a length of the first flat, strip like member 12, a first end 26 proximate end 16, a second end 28 opposite the first end 26 and proximate end 18, an inner mating surface 30, and an outer bonding surface 32 opposite the inner mating surface 30.

The hold open mechanism 10 further includes one or more pivot members 34 integrated into the second flat, strip like member 14. In at least one embodiment, the one or more pivot members 34 separates the second flat, strip like member 14 into a side seal portion 36 and an operable portion 38, where the side seal portion 36 is coupled to the operable portion 38 (best viewed in FIGS. 5 and 6).

Figure 3:
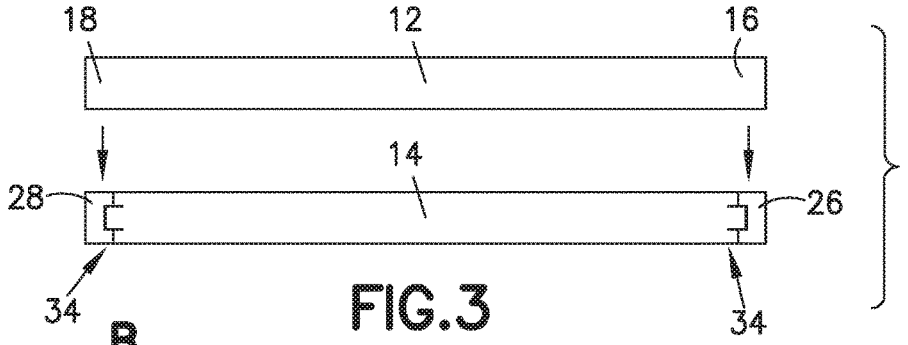
FIG. 3 is an exploded view of the first member and second member of the hold open mechanism of FIG. 1 in accordance with one embodiment.
Figure 4:
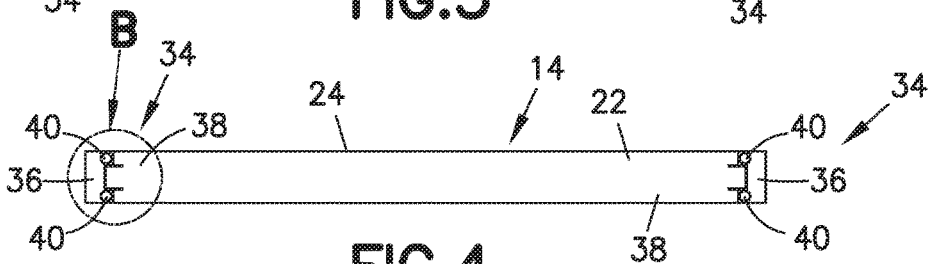
FIG. 4 is view of the second member of FIG. 3 illustrating the bonding points of the hold open mechanism of FIG. 1 in accordance with one embodiment.

FIG. 3 depicts an exploded view of the first member 12 and second member 14 of the hold open mechanism 10 in accordance with one embodiment. FIG. 3 depicts the one or more pivot members 34 integrated into the second member 14. FIG. 4 depicts a front view of the second member 14 illustrating bonding points 40 of the hold open mechanism 10. In at least one embodiment, first member 12 and second member 14 are joined, connected or bonded along or at one or more of the bonding points 40. More specifically, inner mating surface 20 is joined, connected or bonded to inner mating surface 30. More specifically the first member 12 is bonded to the second member 14 forming the hold open mechanism 10, the side seal portion 36 of the second member 14 is bonded to the ends 16, 18 of the first member 12 using any method known in the art including heat sealing, spot sealing, ultrasonic welding, adhesive bonding and the like.

Figure 5:
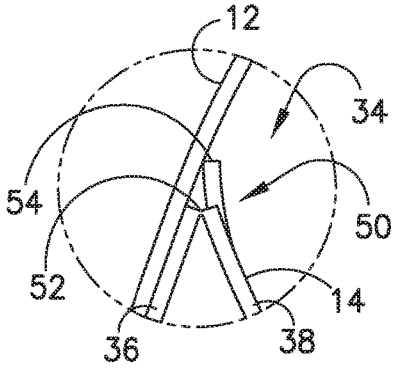
FIG. 5 is a sectional view of the detail A of FIG. 2 illustrating the flexure in accordance with one embodiment.
Figure 6:
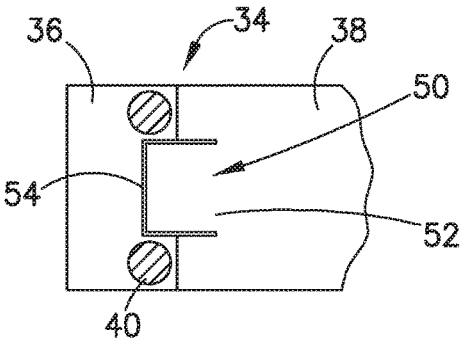
FIG. 6 is a enlarged sectional view of the detail B of FIG. 4 illustrating the bonding in accordance with one embodiment.

The one or more pivot members 34 are illustrated in greater detail in FIGS. 5-6, where FIG. 5 depicts an enlarged view of the detail A of FIG. 1 while FIG. 6 depicts an enlarged view of the detail B of FIG. 4. In at least one embodiment, the one or more pivot members comprise a living hinge. More specifically the one or more pivot members 34 comprises a living hinge defined by a thin portion of material coupling outer end corners of the side seal portion 36 and the operable portion 38 of the second member 14.

In at least one embodiment of the hold open mechanism 10 the one or more pivot member comprises a living hinge created by indenting, engraving, or slitting the surface of the strip like material of the second member 14 to a specified blind depth, forming one or more flexures 50. In at least one embodiment, the one or more flexures 50 are integrated into the second member 14 proximate the pivot member, where the one or more flexures 50 are rigidly coupled to the operable portion 38 of the second member 14 including a flexing point 52 parallel with that of the pivot member allowing the flexure 50 to move from a first flat configuration (best viewed in FIGS. 3 and 6) to a second bent or flexed configuration (best viewed in FIG. 5).

As illustrated in FIG. 5, the one or more flexures 50 includes a sliding edge 54 generally parallel with that of the pivot member which engages the surface of the first member 12. A second configuration of the flexure 50 holds the operable portion 38 of the second member 14 in a separated orientation relative to that of the first member 12, where the mating surfaces are generally between about 90 degrees and 180 degrees of separation relative to one another. The body of the flexure 50 intersects the pivot member, where the one or more flexures 50 created by punching or cutting the surface of the strip like material of the second member 14 to a through depth.

Figure 7:
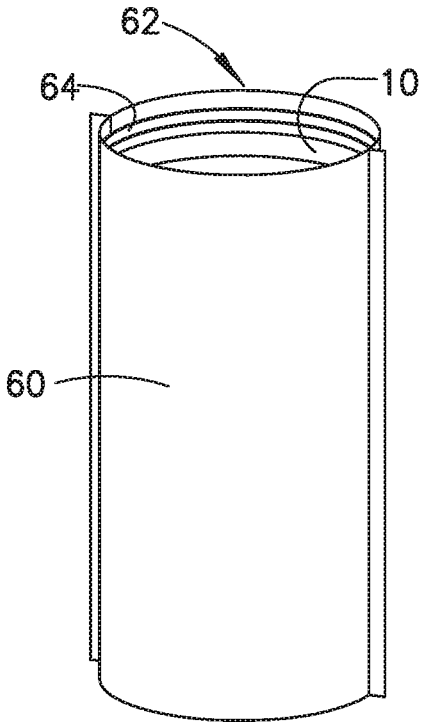
FIG. 7 is a side view of the fitment style pull-snap open mechanism mounted to a package in an open position in accordance with one embodiment.
Figure 8:
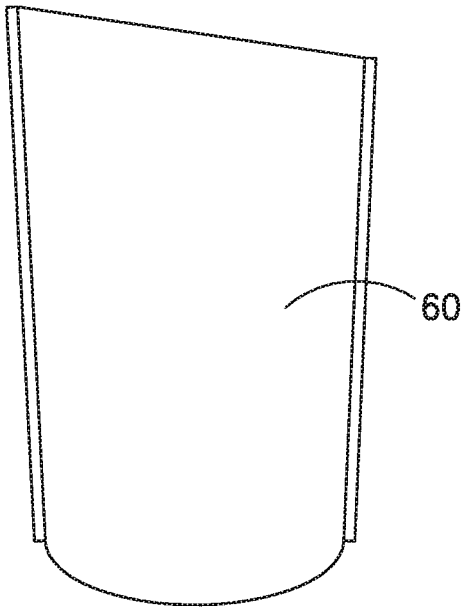
FIG. 8 is a side view of the fitment style pull-snap open mechanism mounted to a package in a closed position in accordance with one embodiment.

FIGS. 7 and 8 depict the hold open mechanism 10 mounted to a package 60. FIG. 7 depicts the hold open mechanism 10 holding the package 60 in an open position in accordance with one embodiment, while FIG. 8 depicts the package 60 in a closed. In at least one embodiment the hold open mechanism 10 is used with a reclosable or resealable mechanism 64 such as a zip type closure and the like to secure the package 60.

Figure 9:
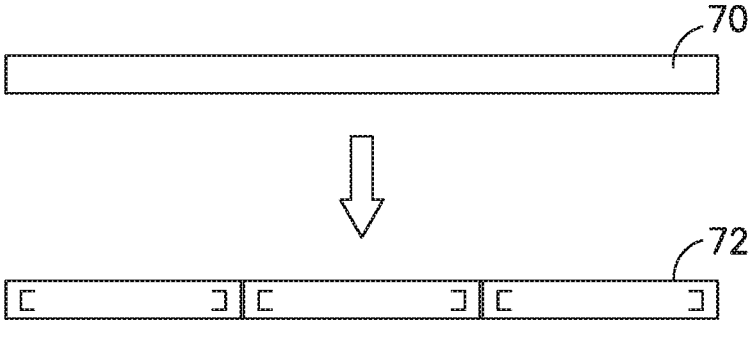
FIG. 9 illustrates the tape feed pull-snap hold open mechanism starting as a homogeneous tape in accordance with one embodiment
Figure 10:
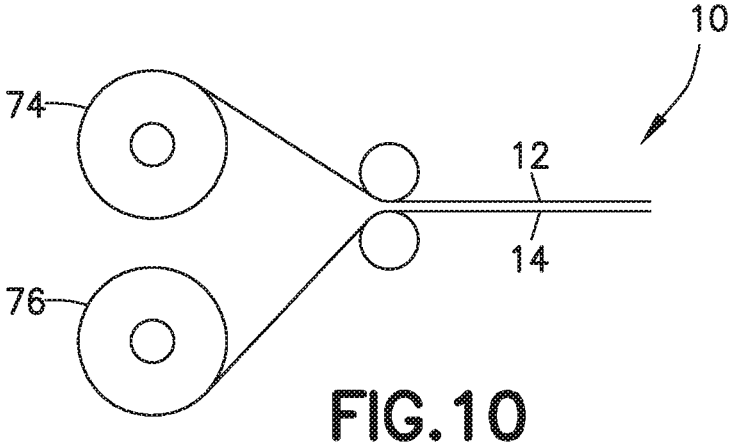
FIG. 10 illustrates the tape feed manufacturing method in accordance with one embodiment.

FIG. 10 illustrates one embodiment of a method of manufacturing or producing the hold open mechanism 10. In at least one embodiment, the first flat, strip like member 12 and the second flat, strip like member 14 are applied proximate the opening 62 of a package 60 as a tape. The first flat, strip like member material 12 is fed as a homogeneous tape 70 as shown in FIG. 9 into a die cutting apparatus where all required cutting, slitting, engraving features are cut into the material. The second flat, strip like member material 14 is similarly fed as a homogeneous tape 70 into a diecutting apparatus where all required cutting, slitting, engraving features are cut into the material 72. The first member tape and second member tape are collected on bobbins 74 and 76, then joined and then bonded to each other, forming segmented hold open mechanisms 10. In at least one embodiment, the hold open mechanisms are fed into a horizontal flexible packaging forming machine or a vertical flexible packaging forming machine, forming packages 60.

A method of using the tape feed hold open mechanism 10 includes applying a separating pressure between the first flat, strip like member 12 and second flat, strip like member 14. The flexure 50 slides from a first flat configuration to a second bent configuration, holding the first member 12 separate from the second member 14. This allows easy access to the contents of the package 60. To close, a compressive pressure is applied between the first member 12 and second member 14. The flexure 50 slides from the second bent configuration to the first flat configuration, thus closing and positioning or mating the first member 12 relative to the second member 14.

The bistable pull-snap hold open mechanism allows a user to easily access the contents of a flexible package. It's designed to fit proximate the opening of a package generally complimenting the functionality of a zip type closure. The device is comprised of a first and second flat strip like member coupled by one or more locking or bistable hinge mechanisms. The locking hinge mechanisms generally include a standard living hinge in addition to one or more spring flaps or flexures which allow the hinge to be biased in an open or closed configuration. When the user wishes to open the package and hold it in this configuration, all that is required is a slight pressure applied to the side walls of the package. When the mechanism reaches a certain point, the hinges lock thus maintaining the sidewalls of the container in an open configuration. When the user wishes to close the mechanism, a slight pressure applied to the external surface of the sidewalls inwards results in the hinges unlocking and rotating towards a closed configuration. The user can then use the zip-type closure to seal the package.

Figure 11:
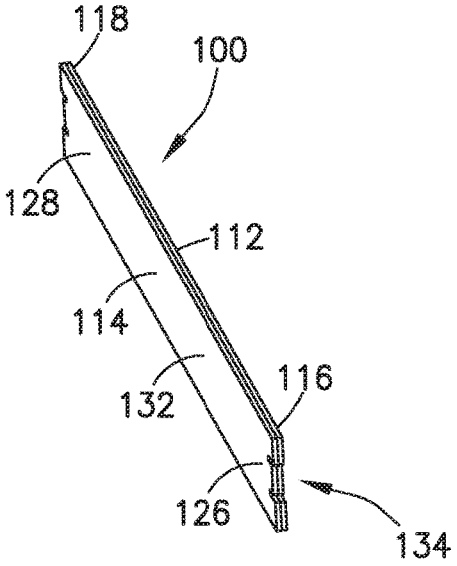
FIG. 11 is an isometric view of the fitment style pull-snap hold open mechanism in an closed position in accordance with one embodiment.
Figure 12:
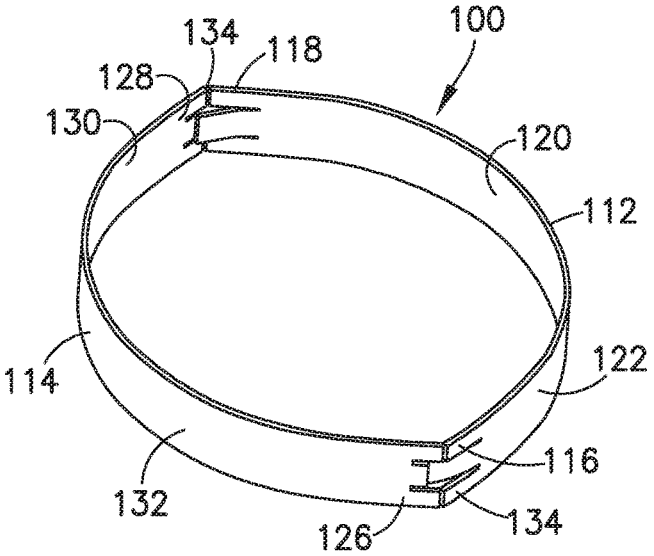
FIG. 12 is a isometric top view of the hold open mechanism of FIG. 11 in an open position in accordance with one embodiment.

FIGS. 11-12 depict isometric views of a fitment bistable hold open mechanism, generally designated 100, in accordance with one embodiment of the present invention, depicting the hold open mechanism 100 in a first or open position (FIG. 2) and a second or closed position (FIG. 1). In the illustrated embodiment, the hold open mechanism 100 includes at least a generally flexible first flat, strip like member 112 and a generally flexible second flat, strip like member 114. In at least one embodiment, the first flat, strip like member 112, the second, flat strip like member 114 or both are comprised of a polyolefin material. It should be realized that, while polyolefin material is discussed, other materials or combinations are also contemplated.

As illustrated, the first flat, strip like member 112 has a first orientation defined with respect to a length of the second flat, strip like member 114, a first end 116, a second end 118 opposite the first end 116, an inner mating surface 120, and an outer bonding surface 122 opposite the inner mating surface 120. Similarly, the second flat, strip like member 114 has a first orientation defined with respect to a length of the first flat, strip like member 112, a first end 126 proximate end 116, a second end 128 opposite the first end 126 and proximate end 118, an inner mating surface 130, and an outer bonding surface 132 opposite the inner mating surface 130.

The hold open mechanism 100 further includes one or more pivot members 134 pivotably coupling the first flat, strip like member 112 to the second, flat strip like member 114 (best viewed in FIGS. 11 and 12). In at least one embodiment, the one or more pivot members comprises a living hinge defined by a thin portion of material coupling the inner end corners of the first member 112 and second member 114 (best viewed in FIGS. 13 and 14).

The hold open mechanism 100 further includes a flexure group 150 having a longer primary flexure 156 and a shorter secondary flexure 158 where the primary flexure 156 engages with the secondary flexure 158 when the mechanism is moved from closed configuration to an open configuration.

Figure 13:
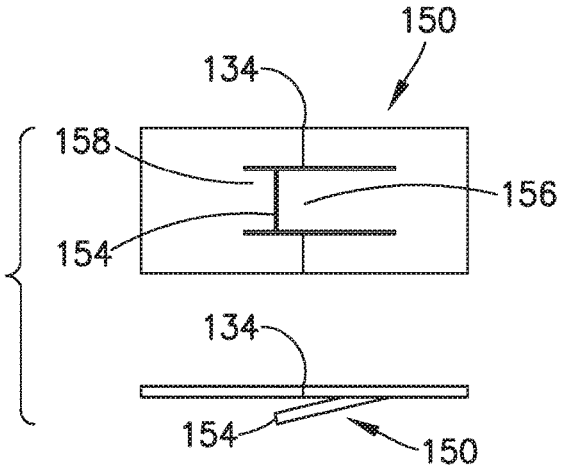
FIG. 13 is an enlarged top and side view of the flexure of FIG. 11 illustrating the flexure starting from an initial slightly bent orientation in accordance with one embodiment.
Figure 14:
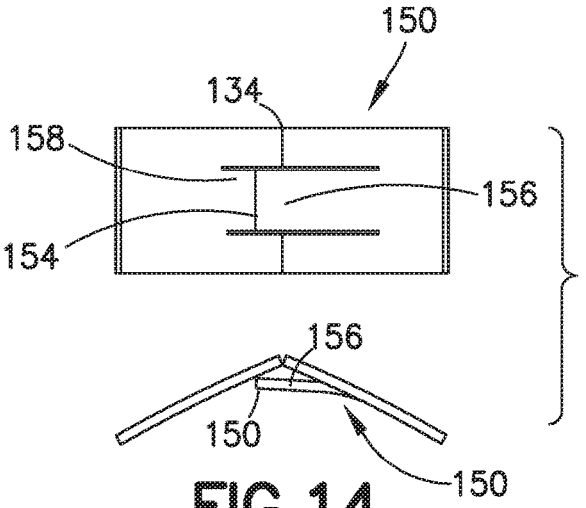
FIG. 14 is an enlarged top and side view of the sliding edge of the flexure of FIG. 11 with the hold open mechanism in an open and engaged configuration in accordance with one embodiment.

FIG. 13 depicts an enlarged top and side view of the primary flexure 156 and secondary flexure 158 of FIG. 11, while FIG. 14 is an enlarged top and side view of the sliding edge of the primary flexure 156 of FIG. 11 with the hold open mechanism 100 in an open configuration in accordance with one embodiment.

In at least one embodiment of the hold open mechanism 100 the one or more pivot member comprises a living hinge created by indenting, engraving, or slitting the surface of the strip like material to a specified blind depth, forming one or more flexures 150. In at least one embodiment, the one or more primary flexures are integrated into the second member 114 proximate the pivot member 134, allowing the primary flexure 156 to move from a first closed and disengaged configuration (best viewed in FIG. 13) to a second open or engaged configuration (best viewed in FIG. 4).

As illustrated in FIG. 13-14, the one or more primary flexures 156 includes a sliding edge 154 generally parallel with that of the pivot member 134 which engages the surface of the secondary flexure 158. A second configuration of the flexure group 150 holds the second member 114 in a separated orientation relative to that of the first member 112, where the mating surfaces are generally between about 90 degrees and 180 degrees of separation relative to one another. The body of the primary flexure 156 intersects the pivot member 134, where the one or more flexures 150 created by punching or cutting the surface of the strip like material of the second member 114 to a through depth.

FIGS. 7 and 8 depict the hold open mechanism 10 mounted to a package 60. It is contemplated that the hold open mechanism 100 may be used in a similar fashion, holding the package 60 in an open position in accordance with one embodiment as illustrated in FIG. 7. In at least one embodiment the hold open mechanism 100 is used with a reclosable or resealable mechanism 64 such as a zip type closure and the like to secure the package 60.

Figure 15:
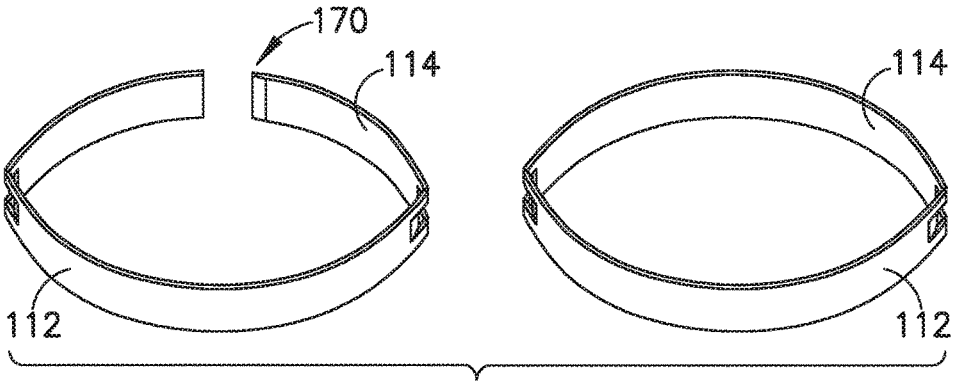
FIG. 15 illustrates the manufacturing method of making the fitment in accordance with one embodiment.

FIG. 15 illustrates one embodiment of a method of manufacturing or producing the hold open mechanism 100. In at least one embodiment, the first flat, strip like member 112 and the second flat, strip like member 114 are applied proximate the opening of a package 60 as a fitment, the first and second flat, strip like member material fed as a homogeneous tape into a diecutting apparatus where all required cutting, slitting, engraving features are cut into the material. One or more separation points 170 are cut into the material. The separation points 170 are bonded, forming segmented hold open mechanisms and fed into a horizontal flexible packaging forming machine or a vertical flexible packaging forming machine.

Figure 16:
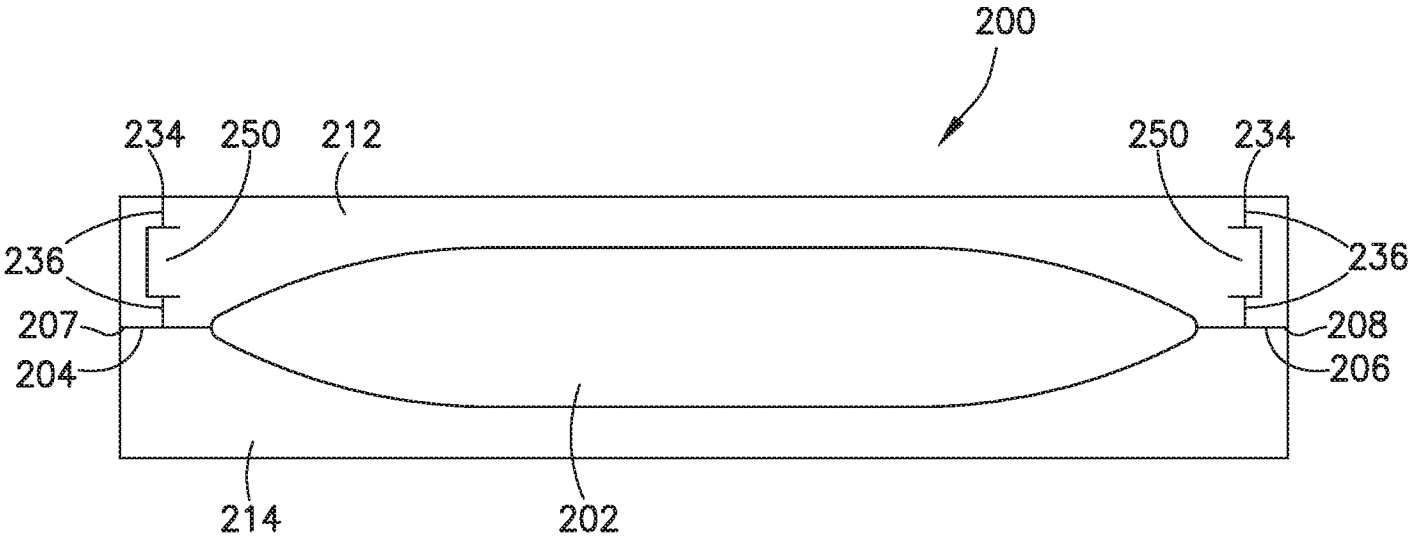
FIG. 16 illustrates the bistable pull-snap hold open mechanism or device made from single die cut piece before folding and welding.

FIG. 16 illustrates another embodiment of a method of manufacturing or producing the bistable pull-snap hold open mechanism 200. Referring to FIG. 16, the hold open mechanism 200 is injection molded or extruded into a rectangular shape and then die cut into the shape shown. Non-limiting exemplary materials for extrusion or injection molding include polypropylene, polyethylene, high density polyethylene, polystyrene, polybutylene, ethylene-propylene-butylene terpolymer and ethylene-propylene copolymer. The die cutting operation not only removes a center portion 202 from the rectangular shape, but also forms two horizontal cuts 204, 206 at each end of the material in order for the two halves to be folded upon each other to allow the hold open mechanism 200 to be formed from a single rectangular strip or piece of material. The two horizontal cuts 204, 206 pass essentially through the entire thickness of the material. There may also be uncut tabs 207, 208 at each end of the horizontal cuts 204, 206 that provides for integrity to the rectangular piece prior to the folding operation. The uncut tabs may be less than 2 mm, or less than 1.5 mm, or less than 1.0 mm, or less than 0.5 mm in width A preferred shape of the center portion 202 removed in the die cutting or punching process is elliptical. The first flat, strip like member 212 is folded onto the second, flat strip like member 214 at the two horizontal cuts 204, 206. Upon folding of the first flat, strip like member 212 onto the second, flat strip like member 214, the narrow uncut tabs 207, 208 break or rupture to allow for the first flat, strip like member 212 to be completely separated from the second flat, strip like member 214. The locking hinge mechanism 234 of the hold open mechanism 200 is also formed in the die cutting or punching operation by simultaneously providing a standard living hinge 236 in addition to one or more spring flaps or flexures 250 in the first flat, strip like member 212, which allows the locking hinge mechanism 234 to be biased in an open or closed configuration as discussed above in more detail in FIG. 13 and FIG. 14. Non-limiting exemplary die cutting or punching operations include a rotary flat-bed operation, laser die cutting operation or a digital die cutting operation.

Figure 17C:
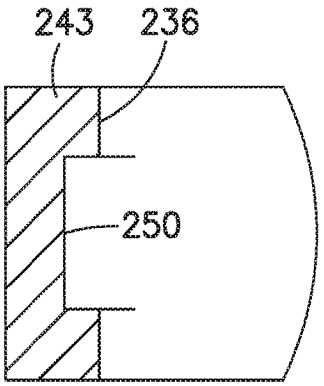
FIGS. 17A, 17B and 17C illustrate various weld configurations for the joining or bonding the first, flat strip like member and the second, flat strip like member together at, adjacent to or near their respective ends of the bistable pull-snap hold open mechanism or device.
Figure 17B:
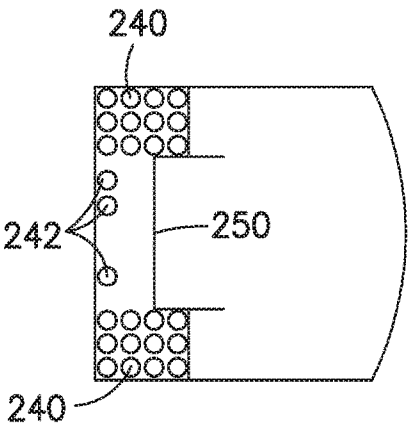
Figure 17A:
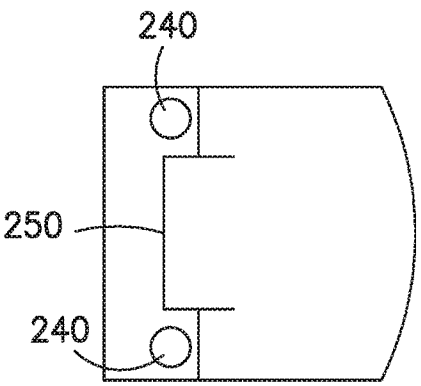

After the first flat, strip like member 212 is folded onto the second, flat strip like member 214, the first member 212 and second member 214 are joined, connected or bonded along or at one or more of the bonding points 240 adjacent to, proximate to or at the edge as shown in FIGS. 17A and 17B or along the entire edge area as shown in FIG. 17C. As shown in FIG. 17A, there are two bonding points 240 above and below the flexure 250. Hence, at total of four bonding points for connecting both sides of the hold open mechanism 200 (two per edge region or area). Alternatively, as shown in FIG. 17B, there may be a multitude of bonding points 240 both above and below the flexure 250. A multitude of bonding points may range from 2 to 20, or 4 to 18, or 6 to 16, or 8 to 14, or 10 to 12 above and below the flexure 250. As shown in FIG. 17B, there are 12 bonding points 240 both above the below the flexure 250 in the edge region or area. Alternatively, there may also be bonding points 242 between the top and bottom edges of the flexure 250 as shown in FIG. 17B. Alternatively, as shown in FIG. 17C, there may be a bonding, joining or sealing area 243 as opposed to bonding points in the area of the first and second flat strip like member adjacent to the edges of the strip like member and the vertical living hinge 236 and flexure 250. This bonding area 243 as shown in FIG. 17C as diagonal lines connects the first flat, strip like member 212 to the second, flat strip like member 214 at the edges, near the edges or proximate the side edges of the flat, strip like members in order to form the bistable pull-snap hold open mechanism 200.

The bonding points 240, 242 or bonding area 243 may be formed in a hot tool welding process, an ultrasonic welding process, spot sealing process, or an adhesive bonding process. The bonding points 240, 242 are shown as circular in shape FIGS. 17A and 17B, but may alternatively be square, rectangular, triangular, diamond, star, and oval in shape. As the number of bonding points increases, the area or diameter of each bonding point decreases. In another form, there may be 20 to 40 needle point bonding points above and below the flexure 250. The bonding points may have a diameter ranging from 0.1 mm to 20 mm, or 0.2 mm to 18 mm, or 0.4 to 16 mm, or 0.6 to 14 mm, or 0.8 to 12 mm, or 1.0 to 10 mm, or 1.2 to 8 mm, or 1.6 to 6 mm, or 2 to 6 mm, or 3 to 5 mm.

A method of using the fitment bistable feed hold open mechanism 100 includes applying a separating pressure between the first flat, strip like member 112 and second flat, strip like member 114. The flexure 150 slides from a first closed and disengaged configuration to a second open and engaged configuration, the first member 112 separate from the second member 114. This allows easy access to the contents of the package 60. To close, a compressive pressure is applied between the first member 112 and second member 114. The flexure 150 slides from the second bent configuration to the first flat configuration, thus closing and positioning or mating the first member 112 relative to the second member 114.

As discussed above, the bistable pull-snap hold open mechanism disclosed herein includes a living hinge in addition to one or more spring flaps or flexures, which allow the locking hinge mechanism to be biased in an open or closed configuration (as depicted in FIG. 13 and FIG. 14). Referring to FIG. 6, the living hinges incorporated into the top and bottom of one of the flexible flat, strip like members run in the vertical direction from the top or bottom of the strip like member to the spring flap or flexure 50 located in the center of the strip like member.

Figure 18:
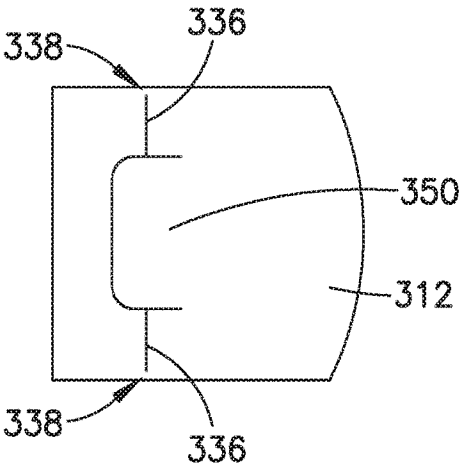
FIG. 18 illustrates the bistable pull-snap hold open mechanism or device with living hinges that do not extend out to the edges of the flat strip like member.

Alternatively, referring to FIG. 18, the vertical living hinges 336 incorporated into the top and bottom of one of the flexible flat, strip like member 312, do not run to either the top or bottom of the strip like member 312. In particular, there is a gap 338 between the top and bottom of the strip like member 312 and the living hinges 336 (also referred to as "strip gap"). In the strip gaps 338, the material thickness is the same as that of the strip like member 312. The strip gap 338 between the top and bottom of the strip like member 312 and the living hinges 336 allows for improved strength and integrity of the living hinges 336 and the snap locking hinge mechanism for repeated use conditions. In particular, the gaps 338 help prevent the tearing of the living hinges 336 from repeated use from opening and closing. The gaps 338 between the top and bottom of the living hinges 336 and the top and bottom of the strip like member 312 may be less than or equal to 2 mm, or less than or equal to 1.7 mm, or less than or equal to 1.5 mm, or less than or equal to 1.2 mm, or less than or equal to 1.0 mm, or less than or equal to 0.7 mm, or less than or equal to 0.5 mm, or less than or equal to 0.2 mm. Alternatively, the length of the gaps 338 between the top and bottom of the strip like member 312 and the top and bottom of the living hinges 336 may be expressed as a percentage of the length of the vertical living hinge, which may be less than 50%, or less than 40%, or less than 30%, or less than 20%, or less than 10%, or less than 5% of the length of the living hinge 336.

Figure 19:
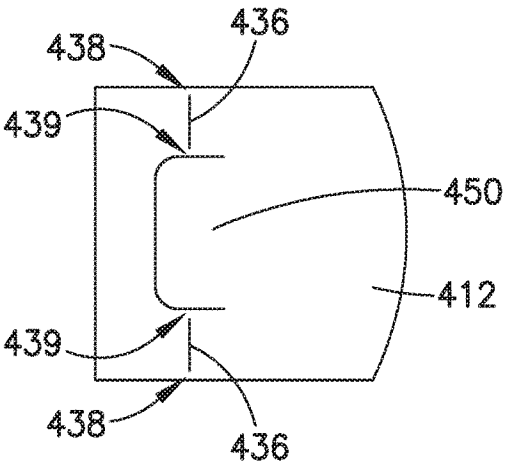
FIG. 19 illustrates the bistable pull-snap hold open mechanism or device with living hinges that do not extend out to the edges of the flat strip like member and to the edges of the spring flap or flexure.

In yet another alternative form, referring to FIG. 19, the vertical living hinges 436 incorporated into the top and bottom of one of the flexible flat, strip like member 412 may include not only a gap 438 between the living hinges 436 and the top and bottom of the strip like member 412 ("strip gap"), but also two gaps 439 running in the vertical direction from the top or bottom of living hinges 436 to the spring flap or flexure 450 located in the center of the strip like member 412 (also referred to as "flap gap"). In the strip 438 gaps and the flap 439 gaps, the material thickness is the same as that of the strip like member 412. Hence, the living hinges 436 incorporated into the top and bottom of one of the flexible flat, strip like member 412 of FIG. 19, the living hinges 436 do not run to either the top or bottom or both of the flexure 450 or the top or bottom of the strip like member 412. In particular, there are additional gaps between the top and/or bottom of the flexure 450 and the living hinge 436. The additional flap gaps 439 between the top and/or bottom of the living hinges 436 and/or between the top and bottom of the spring flap or flexure 450 further improves the strength and integrity of the living hinges 436 and the snap locking hinge mechanism for repeated use conditions during opening and closing. In particular, the additional flap gaps 439 further help prevent the tearing of the living hinge 436 from repeated use and provide further reinforcement for the strip gaps 438. The gap 439 between the top and/or bottom of the living hinge 436 and/or between the top and bottom of the spring flap or flexure 450 may be less than or equal to 2 mm, or less than or equal to 1.7 mm, or less than or equal to 1.5 mm, or less than or equal to 1.2 mm, or less than or equal to 1.0 mm, or less than or equal to 0.7 mm, or less than or equal to 0.5 mm, or less than or equal to 0.2 mm. Alternatively, the length of the gaps 439 between the top and bottom of the flexure 450 and the top and bottom of the living hinges 436 may be expressed as a percentage of the length of the living hinge, which may be less than 50%, or less than 40%, or less than 30%, or less than 20%, or less than 10%, or less than 5% of the length of the living hinge 336. Similarly as shown in FIG. 19, the gap 438 (strip gap) between the top or bottom of the living hinge 436 and the top or bottom of the strip like member 412 may be less than or equal to 2 mm, or less than or equal to 1.7 mm, or less than or equal to 1.5 mm, or less than or equal to 1.2 mm, or less than or equal to 1.0 mm, or less than or equal to 0.7 mm, or less than or equal to 0.5 mm, or less than or equal to 0.2 mm.

The living hinges 236, 336, 436 of the bistable pull-snap hold open mechanism disclosed herein may be formed by a slitting operation performed after molding or extrusion in some constructions and are preferably in a vertical orientation as shown in the Figures. Alternatively, the living hinges 236, 336, 436 may be formed by die cutting, or directly in an injection molding process, or laser engraving, among other possible techniques. The living hinges 236, 336, 436 may have a material thickness less than 80 percent of a material thickness of the adjacent portions of the flexible flat, strip like member. In some constructions, the living hinge portions 236, 336, 436 may have a material thickness that is 70 percent or less, 60 percent or less, 50 percent or less, 40 percent or less, or 30 percent or less, 25 percent or less, or 20 percent or less, or 10 percent or less, or 5 percent or less of a material thickness of the adjacent portions of the flexible flat, strip like member. The material thickness of the living hinges 236, 336, 436 can be between about 0.001 inch and about 0.040 inch (e.g., about 0.0254 mm to about 1.016 mm), or about 0.005 inch and about 0.030 inch (e.g., about 0.127 mm to about 0.762 mm), or about 0.010 inch and about 0.020 inch (e.g., about 0.254 mm to about 0.508 mm) in some constructions. The living hinge portions 236, 336, 436 may be also provided as any portion that enables folding, bending, or pivoting. For example, the living hinge 236, 336, 436 may be provided by only a fold or crease in the material.

Figure 20A:
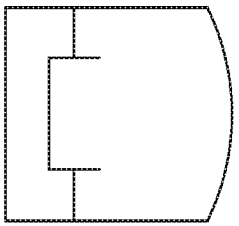
FIGS. 20A-20D illustrate the bistable pull-snap hold open mechanism or device with alternative shapes for the spring flap or flexure.
Figure 20B:
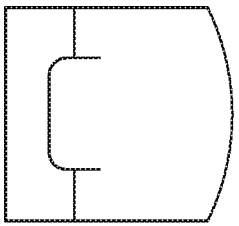
Figure 20C:
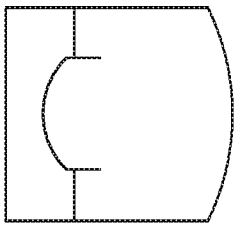
Figure 20D:
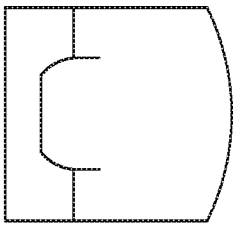

The one or more spring flaps or flexures 50, 150, 250, 350, 450 of the bistable pull-snap hold open mechanism disclosed herein may be cut into a half-square shape as shown in FIGS. 3, 4, 6, 9, 13, 14, 16 and 17. Alternatively, the one or more spring flaps or flexures may be of a half-square shape with rounded corners as shown in FIGS. 18 and 19. Variations on the shape of the one or more spring flaps or flexures are shown in FIGS. 20A-20D. FIG. 20A depicts a half-square shape without rounded corners. FIG. 20B depicts a half-square shape with rounded corners. FIG. 20C depicts a half-elliptical shape. FIG. 20D depicts a half-octagonal shape. Alternatively, the one or more spring flaps or flexures may be of a half-rectangular shape (not shown) with or without rounded corners. Each of the these alternative shapes for the one or more spring flaps or flexures still permit a "snapping" action and noise to occur upon opening and closing of the fitment bistable pull-snap hold open mechanism.

The fitment bistable pull-snap hold open mechanism disclosed herein allows a user to easily access the contents of a flexible package by moving the pull-snap hold open mechanism from the closed to the open configuration or position, which results in an audible "snapping" sound from the mechanism (also referred to as "mechanism opening snap"). The package to which the fitment bistable pull-snap hold open mechanism is attached to is then maintained in the open configuration to allow the user to continue to remove the contents from the package. After the user has finished accessing the contents of the flexible package, the package can be closed by moving the pull-snap hold open mechanism from the open to the closed configuration or position, which again results in an audible "snapping" sound from the mechanism (also referred to as "mechanism closing snap"). The sudden impulse audible noise emanating from the bistable pull-snap hold open mechanism upon both opening and closing may range from 30 to 130 decibels, or 40 to 120 decibels, or 50 to 110 decibels, or 60 to 100 decibels, or 70 to 90 decibels, or 75 to 85 decibels in sound intensity. The sudden impulse sound for the mechanism opening snap and mechanism closing snap occurs over a time period of 1 second or less, or 0.75 seconds or less, or 0.5 seconds or less. The sudden impulse audible noise emanating from the bistable pull-snap hold open mechanism is significantly greater than the sound emanating from a pouch or flexible package that does not include the fitment bistable pull-snap hold open mechanism. The level of sound intensity may also be varied through selection of polyolefin material type (generally stiffer, high modulus polyolefins yielding greater sound levels), surface roughness (generally decreased surface roughness yielding lower sound levels). In one form, the surface roughness may be varied through the use of surface coatings, including, but not limited to, acrylic coatings, silicon oxide coatings, PVOH coatings and PVdC coatings.

Figure 21:
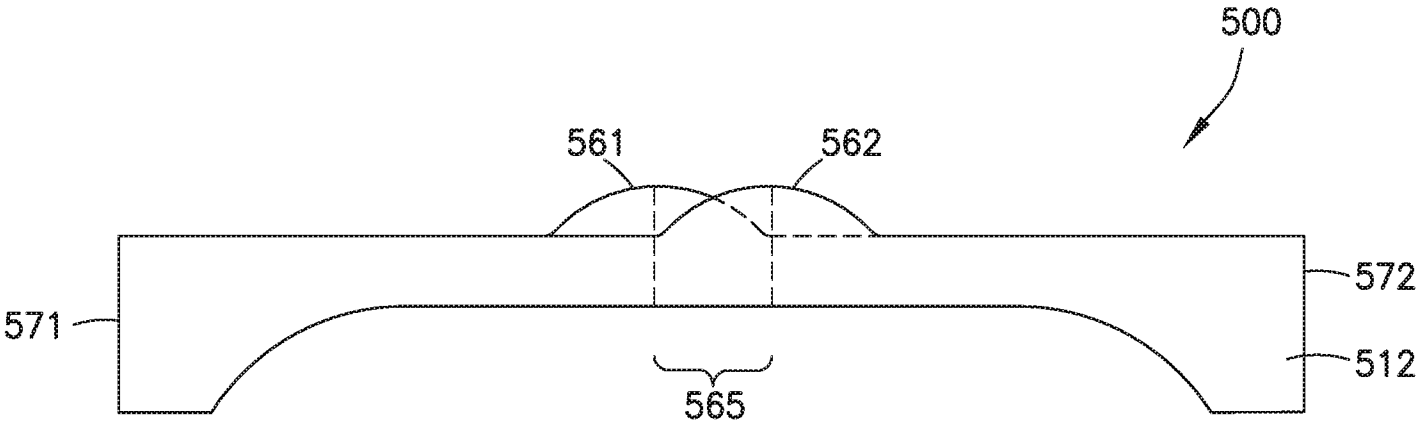
FIG. 21 illustrates the bistable pull-snap hold open mechanism or device with offset grab tabs extending from the top of the first, flat strip like member and the top of the second, flat strip like member.

The bistable pull-snap hold open mechanism or device disclosed herein may optionally include a pair of pouch opening segments or tabs (also referred to herein as "grab tabs") extending from the top of the first flat, strip like member and the top of the second flat, strip like member of the device that are used to facilitate the opening and closing of the device and correspondingly the pouch or flexible package. Referring to FIG. 21, the bistable pull-snap hold open mechanism 500 includes a pair of grabs tabs 561, 562 extending from the top of the first flat, strip like member 512 and second flat, strip like member (not shown). The pair of grab tabs 561, 562 may be of various shapes, including, but not limited to, semi-circular (as shown in FIG. 21), square, rectangular, trapezoidal, triangular, elliptical, and parallelogram. The pair of grab tabs 561, 562 are located generally about midway between the lateral ends or edges 571, 572 of the device 500 such that they are located close to center of the package (about midway between side edges of the package). Each of the grab tabs 561, 562 may completely overlap with one another (not shown in FIG. 21) when the device 500 is in the closed position. More preferably, each of the grab tabs 561, 562 is slightly offset from one another when the device 500 is in the closed position to facilitate the gripping and handling of the tabs 561, 562 because without an offset it is difficult to grasp and separate the pair of grab tabs 561, 562. The offset 565 between the pair of grab tabs 561, 562 may be measured as the length or distance between the center point of each of the grab tabs 561, 562 when the device 500 is in the closed position. This offset 565 may be 30 mm or less, or 25 mm or less, or 20 mm or less, or 15 mm or less, or 10 mm or less, or 5 mm or less, or 3 mm or less. Alternatively, the offset 565 between the pair of grab tabs 561, 562 may be measured as the percentage of the width of one grab tab 561 that does not completely overlap with the second grab tab 562. The offset may be at least 10%, or at least 20%, or at least 30%, or at least 40% of the width of the pouch opening tab 561, 562. The offset 565 between each grab tab 561, 562 makes it easier to separate them when the device 500 is moved from the closed to the open position. The pair of grab tabs 561,562 are an extension of the first flat, strip like member 512 and second flat, strip like member (not shown) and do not include any type of hinge at the intersection of the grab tab 561, 562 and the first flat, strip like member 512 and second flat, strip like member (not shown). FIG. 21 depicts the bistable pull-snap hold open mechanism or device 500 in the closed configuration with the grab tabs 561, 562 in contact with one another.

Figure 22:
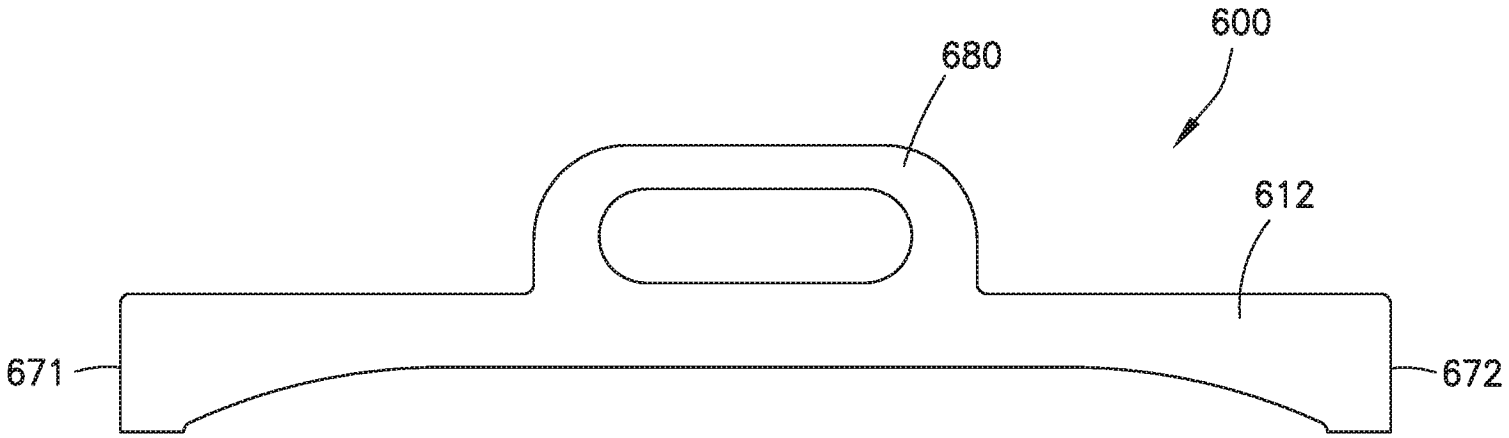
FIG. 22 illustrates the bistable pull-snap hold open mechanism or device with a handle extending from the top of the first, flat strip like member and the top of the second, flat strip like member.

The fitment bistable pull-snap hold open mechanism or device disclosed herein may optionally include a carrying handle extending from the top of the first flat, strip like member and the top of the second flat, strip like member of the device that is used to carry the pouch or flexible package and its contents. Referring to FIG. 22, the bistable pull-snap hold open mechanism 600 includes a handle 680 extending from the top of the first flat, strip like member 612 and second flat, strip like member (not shown). The handle 680 may be of various shapes, including, but not limited to rectangular (as shown in FIG. 22), square, circular, semi-circular, trapezoidal, triangular, elliptical, and parallelogram. The handle 680 is located generally about midway between the lateral ends or edges 671, 672 of the device 600 such that it is located close to center of the package (about midway between side edges of the package).

Figure 23B:
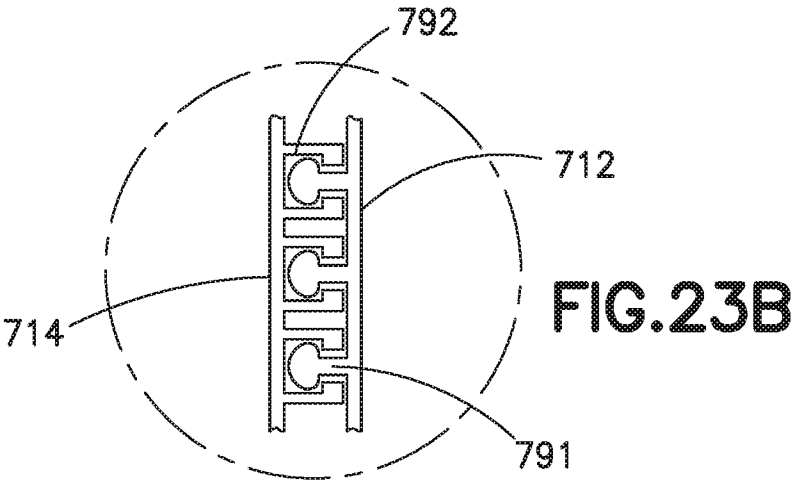
FIGS. 23A and 23B
Figure 23A:
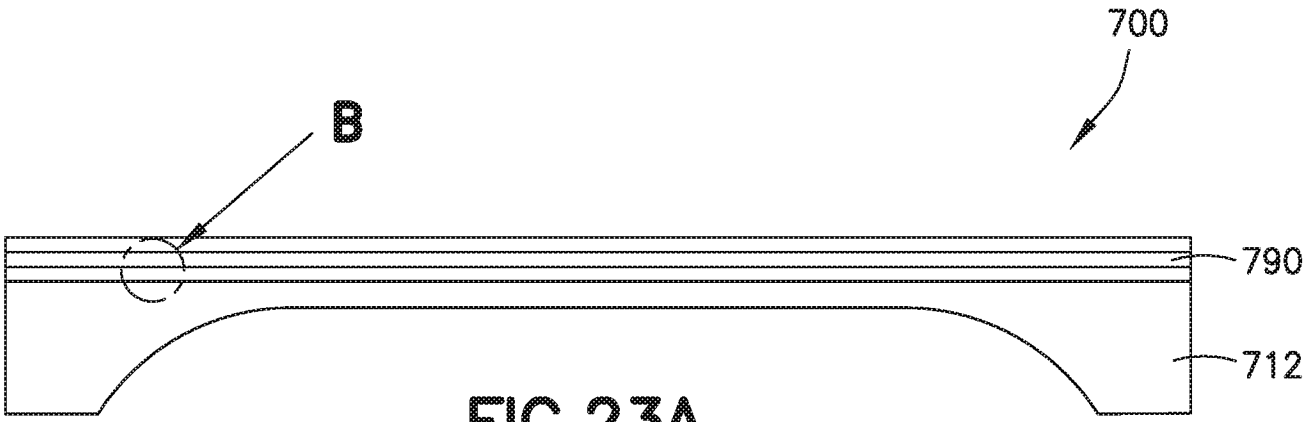

The bistable pull-snap hold open mechanism or device disclosed herein may optionally include a male-female closure mechanism (zip or zipper type closure mechanism) near the top of the first flat, strip like member and the top of the second flat, strip like member of the device that is used to reclose the top of the device and the package to which it is affixed to. Referring to FIG. 23A, the bistable pull-snap hold open mechanism 700 includes a male-female closure mechanism 790 that traverses the entire width of the device 700. Alternatively, the male-female closure mechanism 790 may traverse only a portion of the entire width of the device (not shown). For example, the male-female closure mechanism may traverse less than 90%, or less than 70%, or less than 50%, or less than 30% of the width of the device. Alternatively, the male-female closure mechanism may be a series of spaced segments (not shown). As shown in FIG. 23B, the male-female closure mechanism 790 includes a male member 791 that is either integrated into or affixed to the inside wall of the first flat, strip like member 712 and a female member 792 that is either integrated into or affixed to the inside wall of the second flat, strip member 714. The bistable pull-snap hold open mechanism or device 700 disclosed herein may optionally include a zipper tab or handle (not shown) on the outside of the male-female closure mechanism 790 to help facilitate the opening and closing of the device 700 and the flexible package or pouch to which it is affixed to.

Figure 24B:
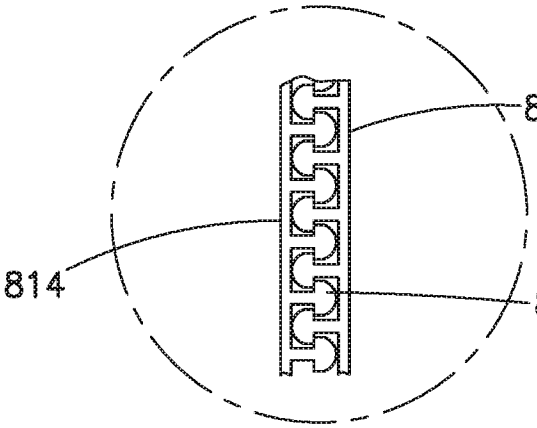
FIGS. 24A and 24B
Figure 24A:
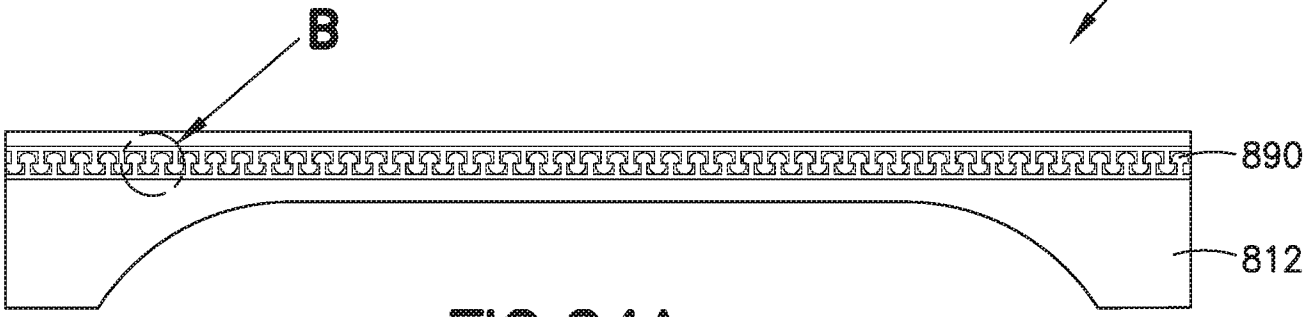

The bistable pull-snap hold open mechanism or device disclosed herein may optionally include a hook and loop fastening system or closure mechanism (Velcro®) or a hook and hook fastening system or closure mechanism (Aplix®) near the top of the first flat, strip like member and the top of the second flat, strip like member of the device that is used to reclose the top of the device and the package to which it is affixed to. Referring to FIG. 24A, the bistable pull-snap hold open mechanism 800 includes a hook and hook fastening system or mechanism 890. The hook and hook fastening system 890 traverses the entire width of the device 800. As shown in FIG. 24B, the hook and hook fastening system 890 includes a hook portion or member 891 that is either integrated into or affixed to the inside wall of both the first flat, strip like member 812 and the inside wall of the second flat, strip member 814. Alternatively, the hook and loop fastening system or closure mechanism or a hook and hook fastening system or closure mechanism may traverse only a portion of the entire width of the device (not shown). For example, the fastening system may traverse less than 90%, or less than 70%, or less than 50%, or less than 30% of the width of the device. Alternatively, the hook and loop or hook and hook fastening system may be a series of spaced segments (not shown). The profile of the hook may be of various shapes and configurations, including, but not limited to, round, rectangular, curved and mushroom shaped.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A fitment bistable pull-snap hold open mechanism, comprising:

a flexible first flat strip comprised of a polyolefin material having:

a first end;

a second end opposite the first end;

an inner mating surface;

an outer bonding surface opposite the inner mating surface;

a flexible second flat strip positioned relative to the first flat strip, the second flat stripe comprised of a polyolefin having:

a first end;

a second end opposite the first end;

an inner mating surface;

an outer bonding surface opposite the inner mating surface;

one or more pivot members integrated into the second flat strip separating the second flat strip into a side seal portion and an operable portion, the side seal portion coupled to the operable portion, wherein the first flat strip is coupled to the second flat strip at both the first ends and the seconds ends with two or more bonding points at each of the first and second ends, wherein the one or pivot members comprise a vertical living hinge and a flexure allowing the fitment bistable pull-snap hold open mechanism to be biased between an open configuration and a closed configuration, wherein the vertical living hinge does not extend to the top edge or the bottom edge of the second flat strip, and wherein the first flat strip and the second flat strip are applied proximate the opening of a flexible package on the inside walls of the package.

2. The fitment bistable pull-snap hold open mechanism of claim 1 wherein the vertical living hinge comprises a thin portion of material coupling outer end corners of the side seal portion and the operable portion of the second flat strip.

3. The fitment bistable pull-snap hold open mechanism of claim 1 wherein the vertical living hinge is created by indenting, engraving, or slitting the inside surface of the polyolefin material of the second flat strip to a specified blind depth.

4. The fitment bistable pull-snap hold open mechanism of claim 1 wherein the vertical living hinge has a material thickness that is 80 percent or less of adjacent portions of the second flat strip.

5. The fitment bistable pull-snap hold open mechanism of claim 1 wherein the vertical living hinge has a material thickness that is 25 percent or less of adjacent portions of the second flat strip.

6. The fitment bistable pull-snap hold open mechanism of claim 1 wherein the gap between the top edge of the second flat strip and top of the vertical living hinge is less than or equal to 2 mm.

7. The fitment bistable pull-snap hold open mechanism of claim 1 wherein the gap between the bottom edge of the second flat strip and bottom of the vertical living hinge is less than or equal to 2 mm.

8. The fitment bistable pull-snap hold open mechanism of claim 1 wherein the gap between the top edge of the second flat strip and top of the vertical living hinge is less than 50% of the length of the vertical living hinge.

9. The fitment bistable pull-snap hold open mechanism of claim 1 wherein the gap between the bottom edge of the second flat strip and bottom of the vertical living hinge is less than 50% of the length of the vertical living hinge.

10. The fitment bistable pull-snap hold open mechanism of claim 1 wherein the vertical living hinge does not extend to the top edge or the bottom edge of the flexure.

11. The fitment bistable pull-snap hold open mechanism of claim 10 wherein the gap between the top edge and bottom edge of the flexure and the vertical living hinge is less than or equal to 2 mm.

12. The fitment bistable pull-snap hold open mechanism of claim 10 wherein the gap between the top edge and bottom edge of the flexure and the vertical living hinge is less than 50% of the length of the vertical living hinge.

13. The fitment bistable pull-snap hold open mechanism of claim 1, wherein for the two or more bonding points at each of the first and second ends there is one bonding point positioned above the top edge of the flexure and one bonding point positioned below the bottom edge of the flexure.

14. The fitment bistable pull-snap hold open mechanism of claim 13 further including an additional one or more bonding points positioned between the top edge and bottom edge of the flexure.

15. The fitment bistable pull-snap hold open mechanism of claim 1, wherein for the two or more bonding points at each of the first and second ends there are from 2 to 12bonding points positioned above the top edge of the flexure and from 2 to 12 bonding points positioned below the bottom edge of the flexure.

16. The fitment bistable pull-snap hold open mechanism of claim 15 further including an additional one or more bonding points positioned between the top edge and bottom edge of the flexure.

17. The fitment bistable pull-snap hold open mechanism of claim 1 wherein the two or more bonding points at each of the first and second ends are circular, square, rectangular, triangular, diamond, star, oval or a combination thereof in shape.

18. The fitment bistable pull-snap hold open mechanism of claim 1 wherein the flexure is cut into a shape selected from the group consisting of a half-square, a half-elliptical, a half-octagonal, and a half-rectangular.

19. The fitment bistable pull-snap hold open mechanism of claim 18 wherein the half-square and half-rectangular shapes include rounded corners.

20. The fitment bistable pull-snap hold open mechanism of claim 1 wherein the flexure includes a flexing point parallel with that of the vertical living hinge allowing the flexure to move from a first flat configuration to a second bent, flexed, or engaged configuration.

21. The fitment bistable pull-snap hold open mechanism of claim 20 wherein the flexure includes a sliding edge generally parallel with that of the vertical living hinge which engages the surface of the first flat strip, a second configuration of the flexure holding the operable portion of the second flat strip in a separated orientation relative to that of the first flat strip where the mating surfaces are generally between about 90 degrees and 180 degrees of separation relative to one another, the body of the flexure intersecting the vertical living hinge.

22. The fitment bistable pull-snap hold open mechanism of claim 1 further including a pair of grab tabs, wherein the first grab tab extends from the top edge of the first flat strip and the second grab tab extends from top edge of the second flat strip, and wherein the pair of grab tabs are located about midway between the first ends and seconds ends of the first and second flat strips.

23. The fitment bistable pull-snap hold open mechanism of claim 22 wherein the shape of the pair of grab tabs are selected from the group consisting of semi-circular, square, rectangular, trapezoidal, triangular, elliptical and parallelogram.

24. The fitment bistable pull-snap hold open mechanism of claim 22 wherein the pair of grab tabs completely overlap with each other when the mechanism is in the closed position.

25. The fitment bistable pull-snap hold open mechanism of claim 22 wherein the pair of grab tabs are offset from each other when the mechanism is in the closed position.

26. The fitment bistable pull-snap hold open mechanism of claim 25 wherein the offset is less than 30 mm.

27. The fitment bistable pull-snap hold open mechanism of claim 25 wherein the offset is less than 10 mm.

28. The fitment bistable pull-snap hold open mechanism of claim 25 wherein the offset is at least 20% of the width a grab tab.

29. The fitment bistable pull-snap hold open mechanism of claim 1 further including a carrying handle extending from the top edge of the first strip and the top edge of the second flat strip.

30. The fitment bistable pull-snap hold open mechanism of claim 29 wherein the carrying handle is located about midway between the first ends and seconds ends of the first and second flat strips.

31. The fitment bistable pull-snap hold open mechanism of claim 29 wherein the carrying handle is in the shape selected from the group consisting of rectangular, square, circular, semi-circular, trapezoidal, triangular, elliptical, and parallelogram.

32. The fitment bistable pull-snap hold open mechanism of claim 1 wherein the mechanism makes a sudden audible snapping sound when actuated from the open position to the closed position and from the closed position to the open position.

33. The fitment bistable pull-snap hold open mechanism of claim 32 wherein the sudden audible snapping sound is at least 30 decibels over a time period of less than or equal to 1 second.

34. The fitment bistable pull-snap hold open mechanism of claim 1 wherein the flexible package includes a male-female closure mechanism.

35. The fitment bistable pull-snap hold open mechanism of claim 34 wherein the male-female closure mechanism includes a handle to facilitate the opening and closing of the male-female closure mechanism.

36. The fitment bistable pull-snap hold open mechanism of claim 1 wherein the flexible package includes a hook and loop or a hook and hook fastening system closure mechanism.

37. The fitment bistable pull-snap hold open mechanism of claim 1 wherein the coupled first and second flat strips of the mechanism are made from a single piece of the polyolefin material formed in an extrusion or injection molding process followed by a die cutting or punching process and then followed by a welding process.

38. The fitment bistable pull-snap hold open mechanism of claim 37 wherein the polyolefin material is selected from the group consisting of polypropylene, polyethylene, polybutylene, ethylene-propylene-butylene terpolymer and ethylene-propylene copolymer.

39. The fitment bistable pull-snap hold open mechanism of claim 37 wherein the single piece of the polyolefin material is rectangular in shape.

40. The fitment bistable pull-snap hold open mechanism of claim 39 wherein the die cutting or punching process removes an elliptical shaped center region from the rectangular piece and forms a horizontal cut at each end of the piece to allow for the first flat strip and the second flat strip to be formed.

41. The fitment bistable pull-snap hold open mechanism of claim 40 wherein the die cutting or punching process forms the vertical living hinge and flexure of the one or more pivot members of the second flat strip.

42. The fitment bistable pull-snap hold open mechanism of claim 41 wherein the first flat strip is folded onto the second flat strip at each horizontal cut at each end of the piece.

43. The fitment bistable pull-snap hold open mechanism of claim 42 wherein the welding process couples the first flat strip to the second flat strip at both the first ends and at the second ends by forming the two or more bonding points at each end of the mechanism.

44. The fitment bistable pull-snap hold open mechanism of claim 43 wherein the two or more bonding points have a diameter ranging from 0.2 mm to 20 mm.

45. The fitment bistable pull-snap hold open mechanism of claim 37 wherein the die cutting or punching process is selected from the group consisting of a rotary flat-bed die cutting operation, a laser die cutting operation and a digital die cutting operation.

46. The fitment bistable pull-snap hold open mechanism of claim 37 wherein the welding process is a hot tool welding process, spot sealing process, adhesive bonding process or an ultrasonic welding process.

47. A method of using the fitment bistable pull-snap hold open mechanism of claim 1 comprising:

applying a separating pressure between the first flat strip and second flat strip;

sliding the flexure from a first flat configuration to a second bent configuration, holding the first flat strip separate from the second flat strip allowing easy access to the contents of the package;

applying a compressive pressure between the first flat strip and second flat strip; and sliding the flexure from a second bent configuration to a first flat configuration thus closing and mating the first flat strip relative to the second flat strip to close the package.

48. A fitment bistable pull-snap hold open mechanism, comprising:

a flexible first flat strip comprised of a polyolefin material having:

an inner mating surface;

an outer bonding surface opposite the inner mating surface;

a flexible second flat strip positioned relative to the first flat strip, the second flat stripe comprised of a polyolefin having:

an inner mating surface;

an outer bonding surface opposite the inner mating surface;

one or more pivot members pivotally coupling the first flat strip to the second flat strip;

wherein the first flat strip is coupled to the second flat strip at both the first ends and the seconds ends with two or more bonding points at each of the first and second ends, wherein the one or pivot members comprise a vertical living hinge and one or more flexures allowing the fitment bistable pull-snap hold open mechanism to be biased between an open configuration and a closed configuration, wherein the vertical living hinge does not extend to the top edge or the bottom edge of the second flat strip and does not extend to the top edge or the bottom edge of the one or more flexures, and wherein the first flat strip and the second flat strip are applied proximate the opening of a flexible package on the inside walls of the package.

49. The fitment bistable pull-snap hold open mechanism of claim 48 wherein the vertical living hinge is defined by a thin portion of material coupling the inner end corners of the first flat strip and the second flat strip.

50. The fitment bistable pull-snap hold open mechanism of claim 48 wherein the vertical living hinge is created by indenting, engraving, or slitting the inside surface of the polyolefin material of the second flat strip to a specified blind depth.

51. The fitment bistable pull-snap hold open mechanism of claim 48 wherein the vertical living hinge has a material thickness that is 80 percent or less of adjacent portions of the second flat strip.

52. The fitment bistable pull-snap hold open mechanism of claim 48 wherein the gap between the top edge of the second flat strip and top of the vertical living hinge is less than or equal to 2 mm.

53. The fitment bistable pull-snap hold open mechanism of claim 48 wherein the gap between the bottom edge of the second flat strip and bottom of the vertical living hinge is less than or equal to 2 mm.

54. The fitment bistable pull-snap hold open mechanism of claim 48 wherein the gap between the top edge and bottom edge of the one or more flexures and the vertical living hinge is less than or equal to 2 mm.

55. The fitment bistable pull-snap hold open mechanism of claim 48, wherein for the two or more bonding points at each of the first and second ends there is one bonding point positioned above the top edge of the one or more flexures and one bonding point positioned below the bottom edge of the one or more flexures.

56. The fitment bistable pull-snap hold open mechanism of claim 55 further including an additional one or more bonding points positioned between the top edge and bottom edge of the one or more flexures.

57. The fitment bistable pull-snap hold open mechanism of claim 48, wherein for the two or more bonding points at each of the first and second ends there are from 2 to 12 bonding points positioned above the top edge of the one or more flexures and from 2 to 12 bonding points positioned below the bottom edge of the one or more flexures.

58. The fitment bistable pull-snap hold open mechanism of claim 57 further including an additional one or more bonding points positioned between the top edge and bottom edge of the one or more flexures.

59. The fitment bistable pull-snap hold open mechanism of claim 48 wherein the two or more bonding points at each of the first and second ends are circular, square, rectangular, triangular, diamond, star, oval or a combination thereof in shape.

60. The fitment bistable pull-snap hold open mechanism of claim 48 wherein the one or more flexures are cut into a shape selected from the group consisting of a half-square, a half-elliptical, a half-octagonal, and a half-rectangular.

61. The fitment bistable pull-snap hold open mechanism of claim 60 wherein the half-square and half-rectangular shapes include rounded corners.

62. The fitment bistable pull-snap hold open mechanism of claim 48 wherein the one or more flexures include a flexing point parallel with that of the vertical living hinge allowing the flexure to move from a first flat configuration to a second bent, flexed, or engaged configuration.

63. The fitment bistable pull-snap hold open mechanism of claim 62 wherein the one or more flexures include a sliding edge generally parallel with that of the vertical living hinge which engages the surface of the first flat strip, a second configuration of the one or more flexures holding the operable portion of the second flat strip in a separated orientation relative to that of the first flat strip where the mating surfaces are generally between about 90 degrees and 180 degrees of separation relative to one another.

64. The fitment bistable pull-snap hold open mechanism of claim 48 further including a pair of grab tabs, wherein the first grab tab extends from the top edge of the first flat strip and the second grab tab extends from top edge of the second flat strip, and wherein the pair of grab tabs are located about midway between the first ends and seconds ends of the first and second flat strips.

65. The fitment bistable pull-snap hold open mechanism of claim 64 wherein the shape of the pair of grab tabs are selected from the group consisting of semi-circular, square, rectangular, trapezoidal, triangular, elliptical and parallelogram.

66. The fitment bistable pull-snap hold open mechanism of claim 64 wherein the pair of grab tabs completely overlap with each other when the mechanism is in the closed position.

67. The fitment bistable pull-snap hold open mechanism of claim 64 wherein the pair of grab tabs are offset from each other when the mechanism is in the closed position.

68. The fitment bistable pull-snap hold open mechanism of claim 67 wherein the offset is less than 30 mm.

69. The fitment bistable pull-snap hold open mechanism of claim 67 wherein the offset is at least 20% of the width a grab tab.

70. The fitment bistable pull-snap hold open mechanism of claim 48 further including a carrying handle extending from the top edge of the first flat strip and the top edge of the second flat strip.

71. The fitment bistable pull-snap hold open mechanism of claim 70 wherein the carrying handle is located about midway between the first ends and seconds ends of the first and second flat strips.

72. The fitment bistable pull-snap hold open mechanism of claim 70 wherein the carrying handle is in the shape selected from the group consisting of rectangular, square, circular, semi-circular, trapezoidal, triangular, elliptical, and parallelogram.

73. The fitment bistable pull-snap hold open mechanism of claim 48 wherein the mechanism makes a sudden audible snapping sound when actuated from the open position to the closed position and from the closed position to the open position.

74. The fitment bistable pull-snap hold open mechanism of claim 73 wherein the sudden audible snapping sound is at least 30 decibels over a time period of less than or equal to 1 second.

75. The fitment bistable pull-snap hold open mechanism of claim 48 wherein the flexible package includes a male-female closure mechanism.

76. The fitment bistable pull-snap hold open mechanism of claim 75 wherein the male-female closure mechanism includes a handle to facilitate the opening and closing of the male-female closure mechanism.

77. The fitment bistable pull-snap hold open mechanism of claim 48 wherein the flexible package includes a hook and loop or hook and hook fastening system closure mechanism.

78. The fitment bistable pull-snap hold open mechanism of claim 48 wherein the coupled first and second flat strips of the mechanism are made from a single piece of the polyolefin material formed in an extrusion or injection molding process followed by a die cutting or punching process and then followed by a welding process.

79. The fitment bistable pull-snap hold open mechanism of claim 78 wherein the polyolefin material is selected from the group consisting of polypropylene, polyethylene, polybutylene, ethylene-propylene-butylene terpolymer and ethylene-propylene copolymer.

80. The fitment bistable pull-snap hold open mechanism of claim 78 wherein the single piece of the polyolefin material is rectangular in shape.

81. The fitment bistable pull-snap hold open mechanism of claim 80 wherein the die cutting or punching process removes an elliptical shaped center region from the rectangular piece and forms a horizontal cut at each end of the piece to allow for the first flat strip and the second flat strip to be formed.

82. The fitment bistable pull-snap hold open mechanism of claim 81 wherein the die cutting or punching process forms the vertical living hinge and one or more flexures of the one or more pivot members of the second flat strip.

83. The fitment bistable pull-snap hold open mechanism of claim 82 wherein the first flat strip is folded onto the second flat strip at each horizontal cut at each end of the piece.

84. The fitment bistable pull-snap hold open mechanism of claim 83 wherein the welding process couples the first flat strip to the second flat strip at both the first ends and at the second ends by forming the two or more bonding points at each end of the mechanism.

85. The fitment bistable pull-snap hold open mechanism of claim 84 wherein the two or more bonding points have a diameter ranging from 0.2 mm to 20 mm.

86. The fitment bistable pull-snap hold open mechanism of claim 78 wherein the die cutting or punching process is selected from the group consisting of a rotary flat-bed die cutting operation, a laser die cutting operation and a digital die cutting operation.

87. The fitment bistable pull-snap hold open mechanism of claim 78 wherein the welding process is a hot tool welding process, spot sealing process, adhesive bonding process or an ultrasonic welding process.

88. A method of using the fitment bistable pull-snap hold open mechanism of claim 48 comprising:

applying a separating pressure between the first flat strip and second flat strip;

sliding the one or more flexures from a first flat configuration to a second bent configuration, holding the first flat strip separate from the second flat strip allowing easy access to the contents of the package;

applying a compressive pressure between the first and second flat strips; and sliding the one or more flexures from a second bent configuration to a first flat configuration thus closing and mating the first flat strip relative to the second flat strip to close the package.

89. A fitment bistable pull-snap hold open mechanism, comprising:

a flexible first flat strip comprised of a polyolefin material having:

an inner mating surface;

an outer bonding surface opposite the inner mating surface;

a flexible second flat strip positioned relative to the first flat strip, the second flat stripe comprised of a polyolefin having:

an inner mating surface;

an outer bonding surface opposite the inner mating surface;

one or more pivot members pivotally coupling the first flat strip to the second flat strip;

wherein the first flat strip is coupled to the second flat strip at both the first ends and the seconds ends with a bonding area adjacent to each of the first and second ends, wherein the one or pivot members comprise a vertical living hinge and one or more flexures allowing the fitment bistable pull-snap hold open mechanism to be biased between an open configuration and a closed configuration, wherein the vertical living hinge does not extend to the top edge or the bottom edge of the second flat strip and does not extend to the top edge or the bottom edge of the one or more flexures, and wherein the first flat strip and the second flat strip are applied proximate the opening of a flexible package on the inside walls of the package.

90. The fitment bistable pull-snap hold open mechanism of claim 89 wherein the bonding area is the area between the side edges of the first and second flat strips and the vertical living hinge and one or more flexures of the second flat strip.

91. The fitment bistable pull-snap hold open mechanism of claim 89 wherein the bonding area is formed in a welding process selected from the group consisting of a hot tool welding process, an adhesive bonding process and an ultrasonic welding process.

92. A method of using the fitment bistable pull-snap hold open mechanism of claim 89 comprising:

applying a separating pressure between the first flat strip and second flat strip;

sliding the one or more flexures from a first flat configuration to a second bent configuration, holding the first flat strip separate from the second flat strip allowing easy access to the contents of the package;

applying a compressive pressure between the first and second flat strips; and sliding the one or more flexures from a second bent configuration to a first flat configuration thus closing and mating the first flat strip relative to the second flat strip to close the package.

* * * * *